US007290486B2

(12) United States Patent
Lafond

(10) Patent No.: US 7,290,486 B2
(45) Date of Patent: Nov. 6, 2007

(54) COMPRESSING DEVICE FOR PLASTIC BOTTLES

(76) Inventor: Alain Lafond, 21, 5E Rang, Asbestos, Quebec (CA) J1T 3M7

( * ) Notice: Subject to any disclaimer, the term of this patent is extended or adjusted under 35 U.S.C. 154(b) by 0 days.

(21) Appl. No.: 11/165,392

(22) Filed: Jun. 23, 2005

(65) Prior Publication Data

US 2006/0000371 A1 Jan. 5, 2006

Related U.S. Application Data

(60) Provisional application No. 60/584,331, filed on Jul. 1, 2004.

(51) Int. Cl.
*B30B 15/06* (2006.01)

(52) U.S. Cl. ..... 100/295; 100/214; 100/280; 100/902; 215/391; 215/395; 222/103

(58) Field of Classification Search ..... 100/3, 100/212, 232, 264, 280, 295, 296, 902, 214, 100/233; 220/666, 737, 742; 215/391, 395, 215/900; 222/92, 95, 103; 241/99
See application file for complete search history.

(56) References Cited

U.S. PATENT DOCUMENTS

| | | | | |
|---|---|---|---|---|
| 850,843 | A * | 4/1907 | Melin | 100/212 |
| 4,747,496 | A | 5/1988 | Rendine | |
| 5,025,953 | A | 6/1991 | Doundoulakis | |
| 5,233,173 | A | 8/1993 | Handzlik | |
| 5,233,917 | A * | 8/1993 | Handzlik | 100/232 |
| 5,802,968 | A * | 9/1998 | Kirschner et al. | 100/233 |
| 6,365,202 | B1 | 4/2002 | Ida et al. | |
| 6,418,842 | B1 | 7/2002 | Justis, Jr. | |

* cited by examiner

*Primary Examiner*—Jimmy T. Nguyen

(57) ABSTRACT

A compressing device for plastic bottle uses a pair of plates which are strapped on each side of a bottle. The straps are tightened as the bottle's content is used up. The plates are shaped in such a way so as to reduce crimping on the bottle. Optional accessories such as a saddle to hold the plates on the side of the bottle while installing; a stand to hold the bottle upright; and a handle to facilitate pouring are available.

15 Claims, 7 Drawing Sheets

COMPRESSING DEVICE FOR PLASTIC BOTTLES

Figure 1:
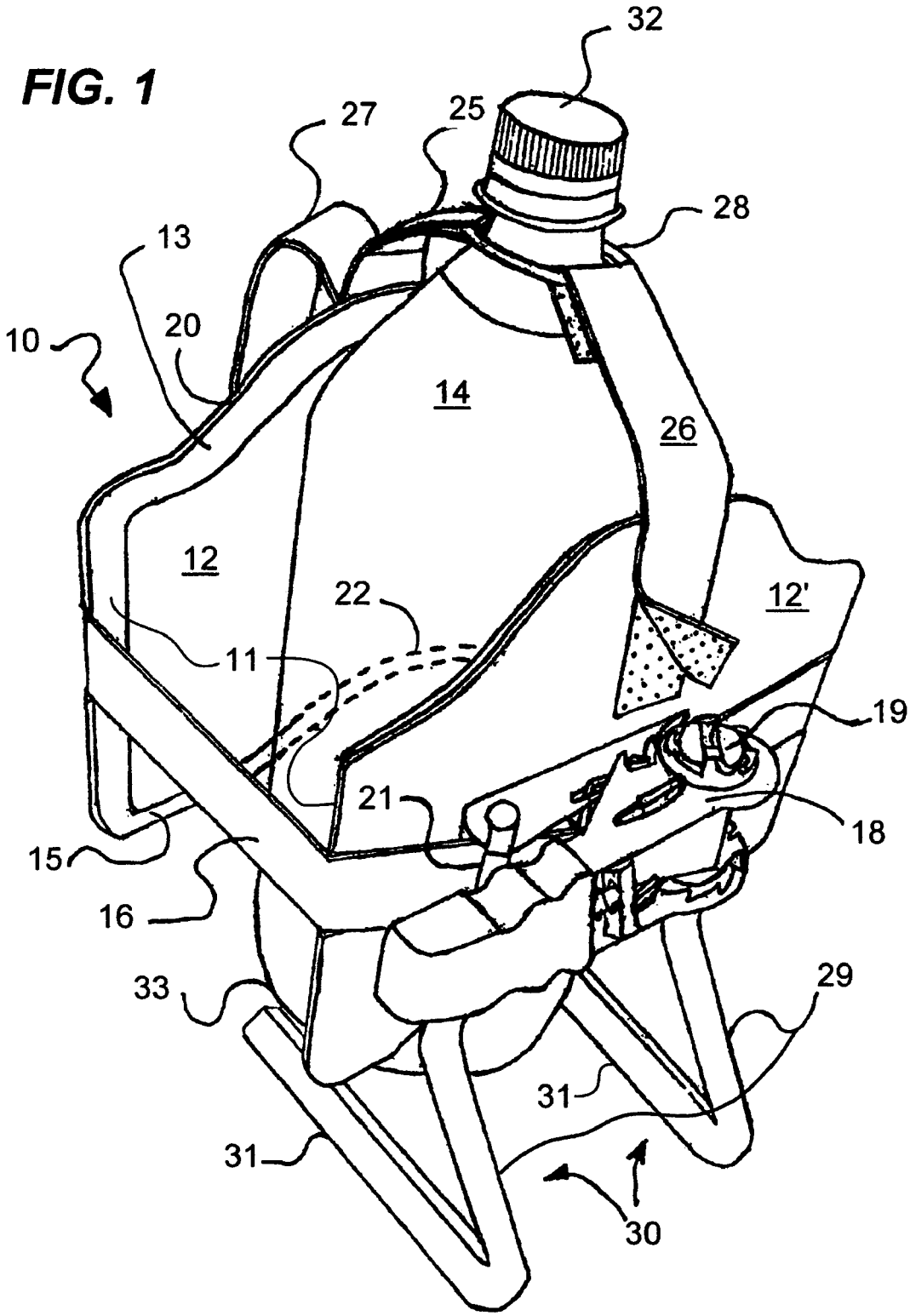

This application claims priority based on provisional application 60/584,331 filed Jul. 1, 2004.

BACKGROUND OF THE INVENTION

1. Field of the Invention

The invention relates generally to kitchen wares but more particularly to a device which compresses plastic bottles in order to keep CO2 inside the liquid as well as reduce the surface exposed to air which reduces oxidation, and at the same time reducing storage volume.

2. Background of the Invention

Large containers are practical and economical but they have the inconvenience that if they are not used-up quickly, the CO2 will escape from the liquid and the drink will become flat. Moreover oxidation may be intensified which may affect the taste of the beverage.

In order to eliminate this drawback, some enterprising inventors have dreamed up a variety of ways to keep air pressure inside the bottle higher than the pressure of the CO2 in order to keep the CO2 in solution. Some methods involve the injection of air, while more practical methods involve reducing the volume of the bottle so that there is little escape volume available for the CO2.

The problem with reducing the volume of bottles is that it can create cracks, creases or punctures in the bottle which makes matters worse.

An improved method of compressing a bottle without damage has to be found.

SUMMARY OF THE INVENTION

The device of this instant invention uses a pair of plates which are strapped on each side of a bottle. The straps are tightened as the bottle's content is used up. The plates are shaped in such a way so as to reduce crimping on the bottle. Optional accessories such as a saddle to hold the plates on the side of the bottle while installing; a stand to hold the bottle upright; and a handle to facilitate pouring are available.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE PREFERRED EMBODIMENT

FIG. 1 Perspective view showing the compressing device on a bottle.

Figure 2:
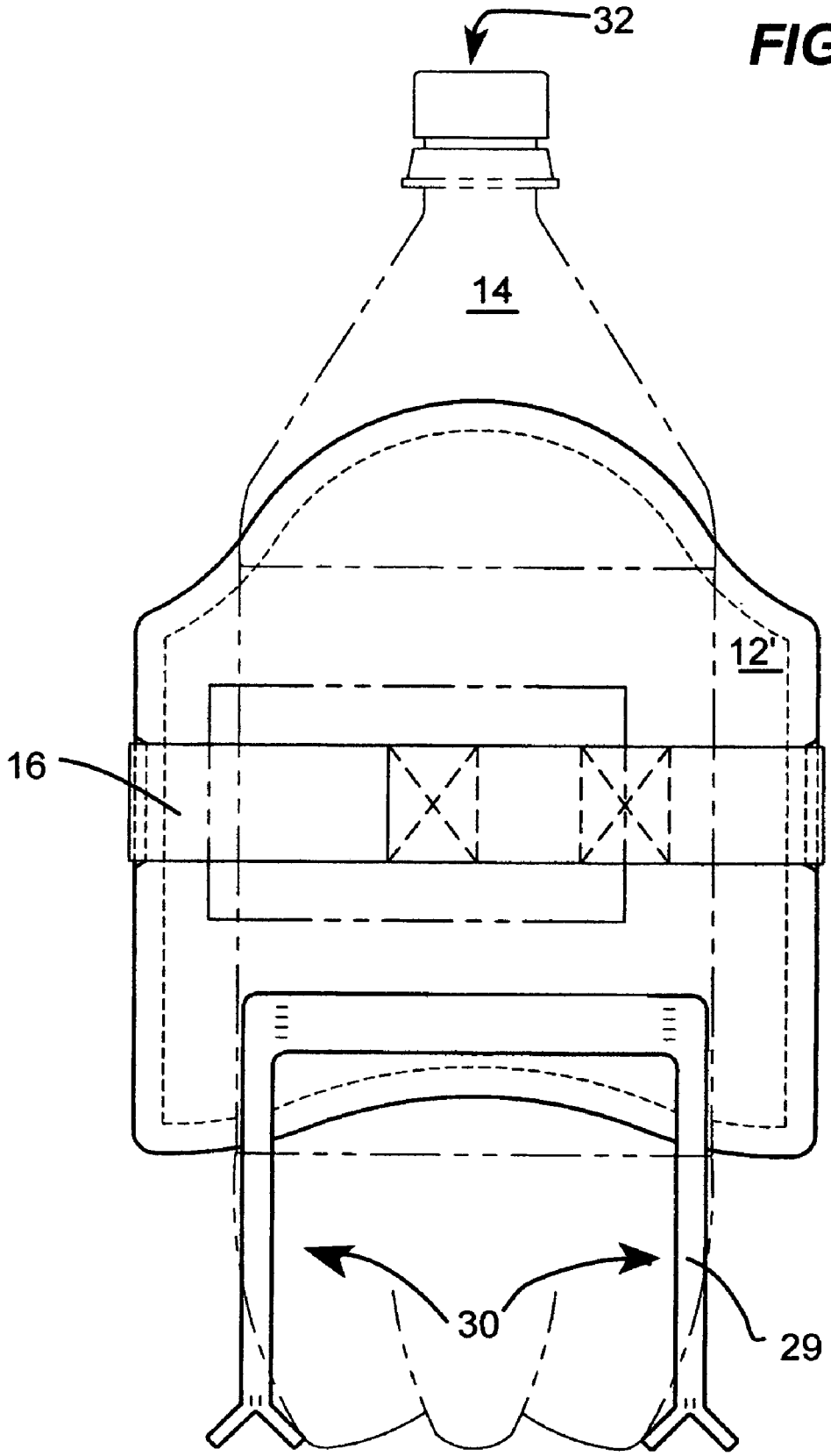

FIG. 2 Front view of the compressing device on a bottle.

Figure 3:
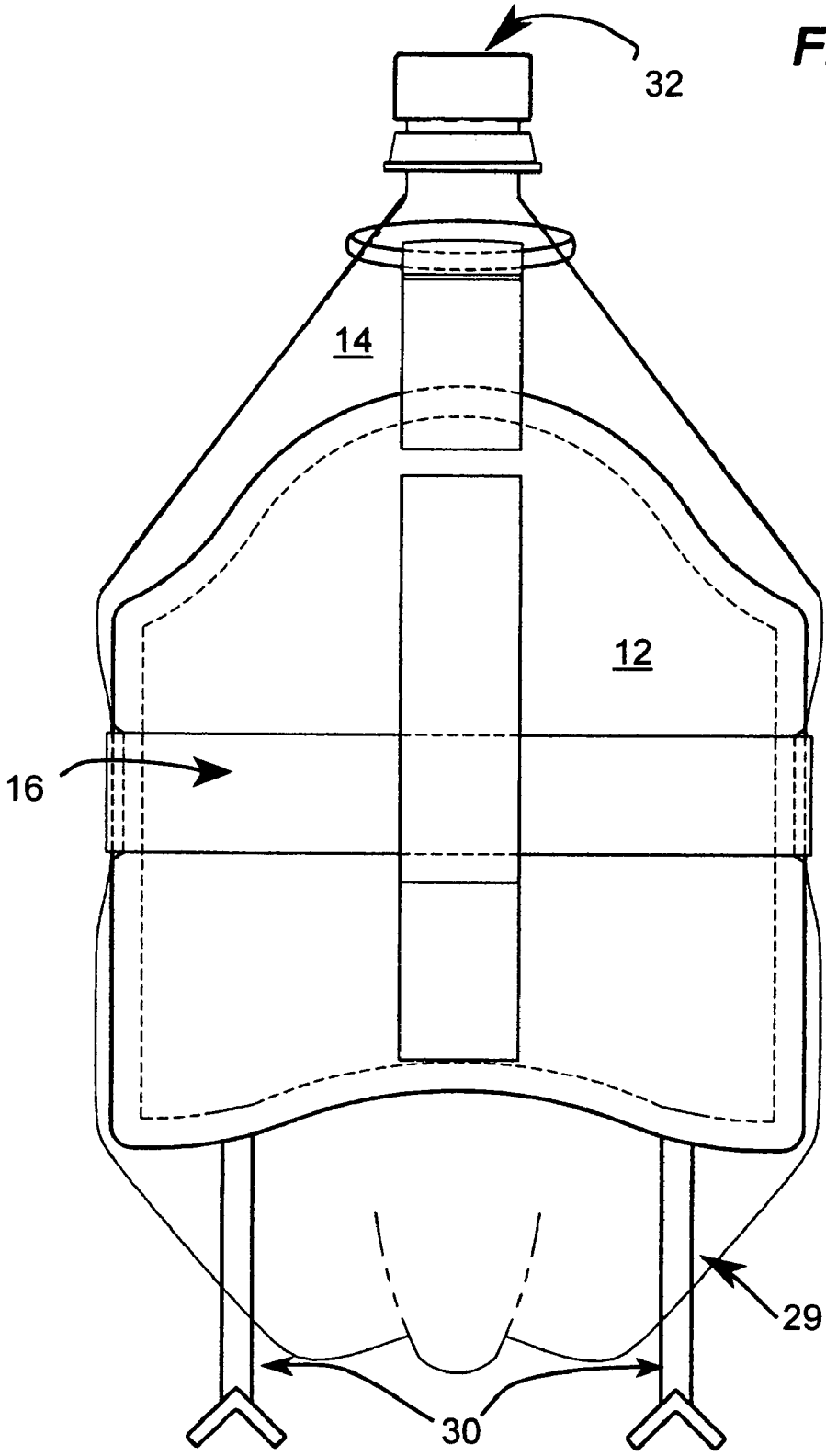

FIG. 3 Rear view of the compressing device on a compressed bottle.

Figure 4:
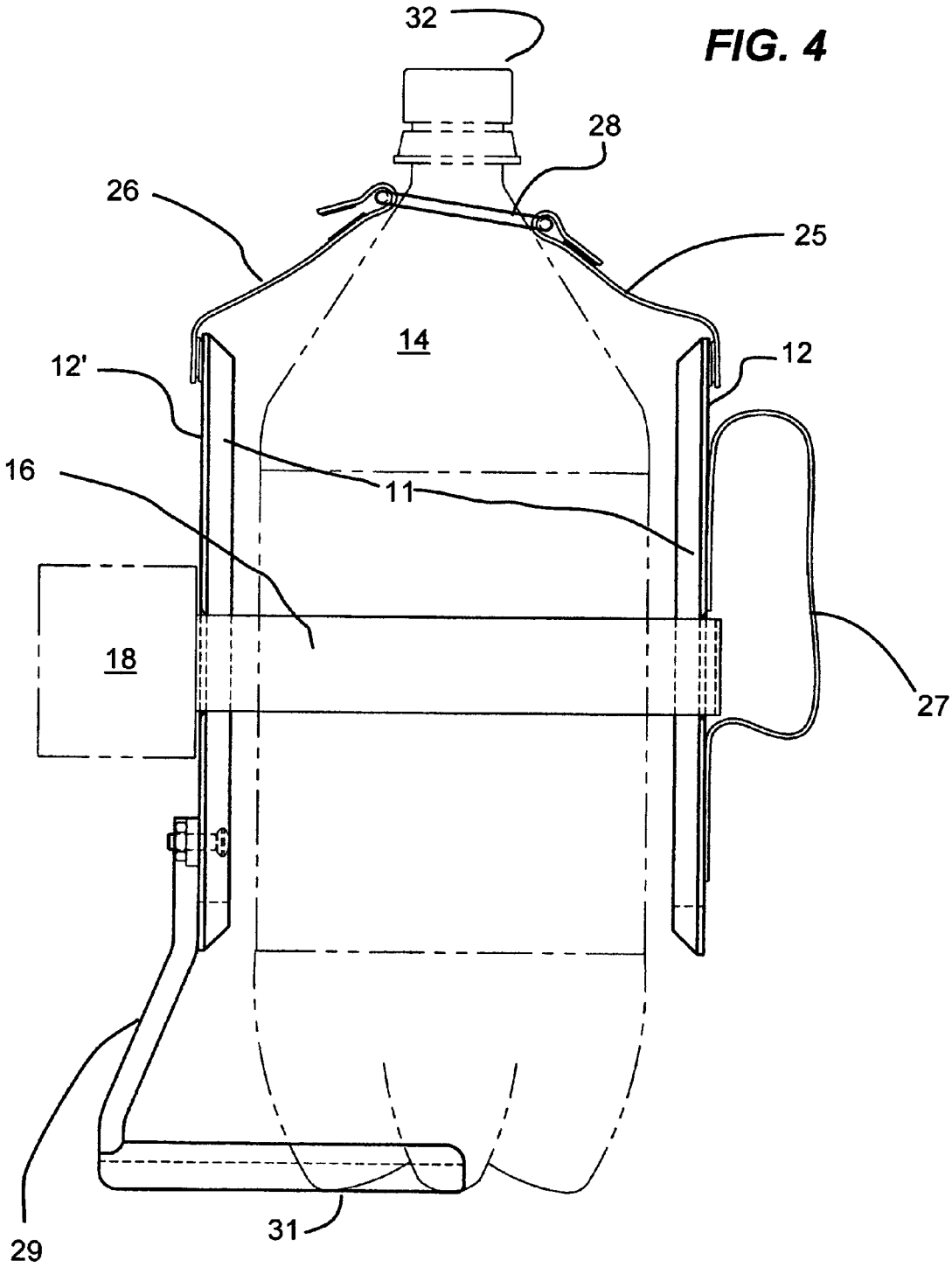

FIG. 4 Side view of the compressing device on a bottle.

Figure 5:
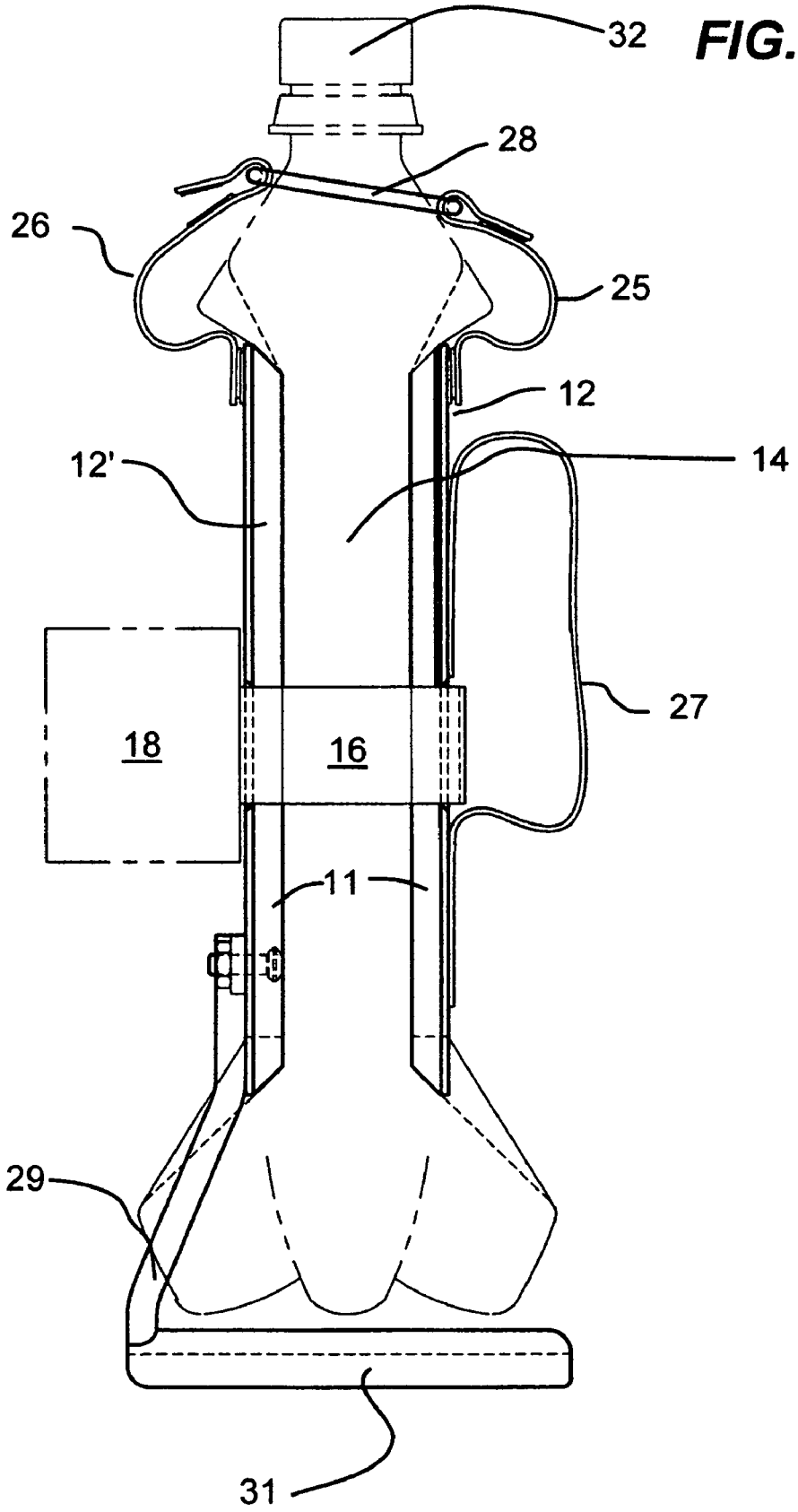

FIG. 5 Side view of the compressing device on a compressed bottle.

Figure 6:
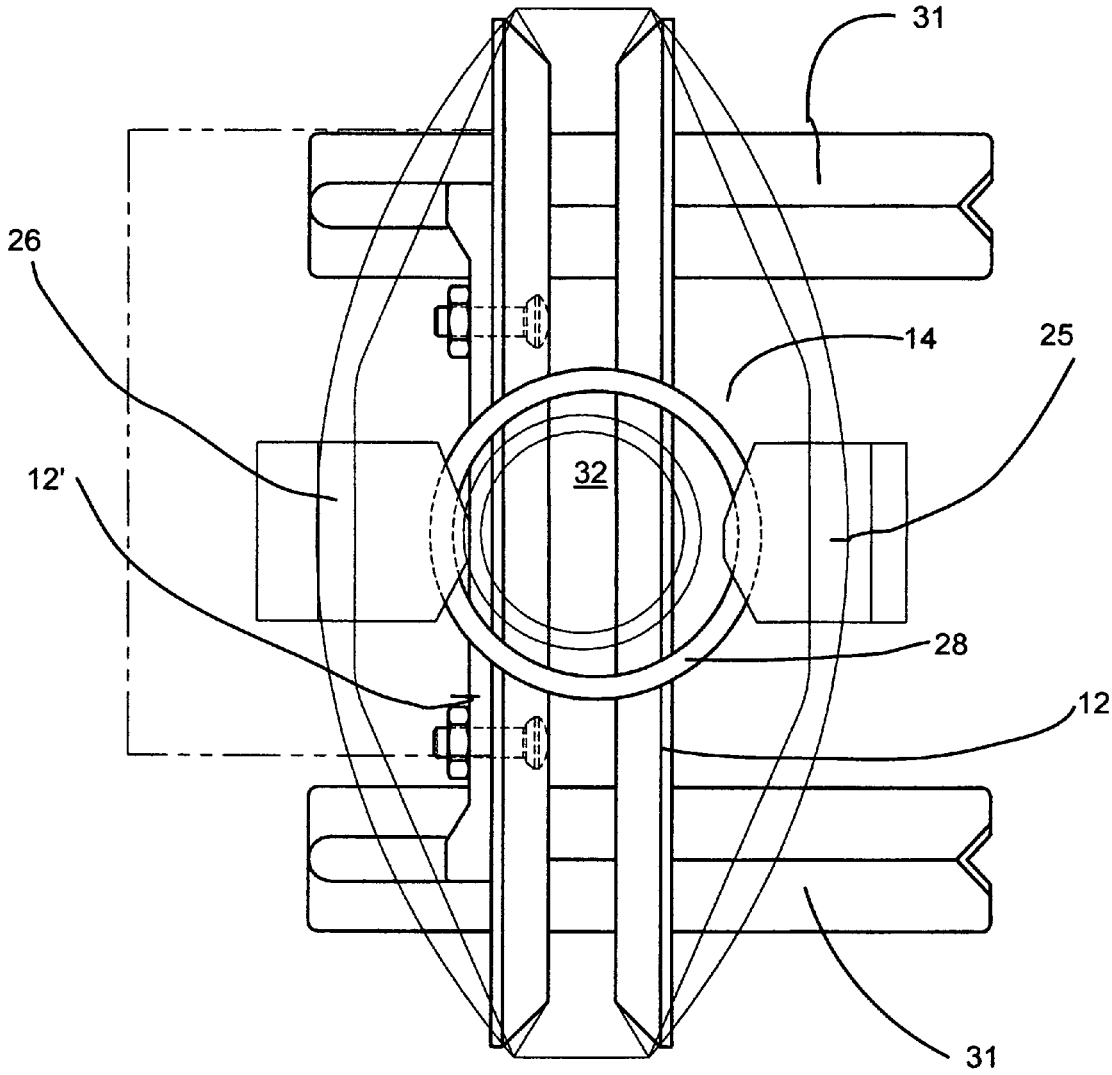

FIG. 6 Top view of the compressing device on a compressed bottle.

Figure 7:
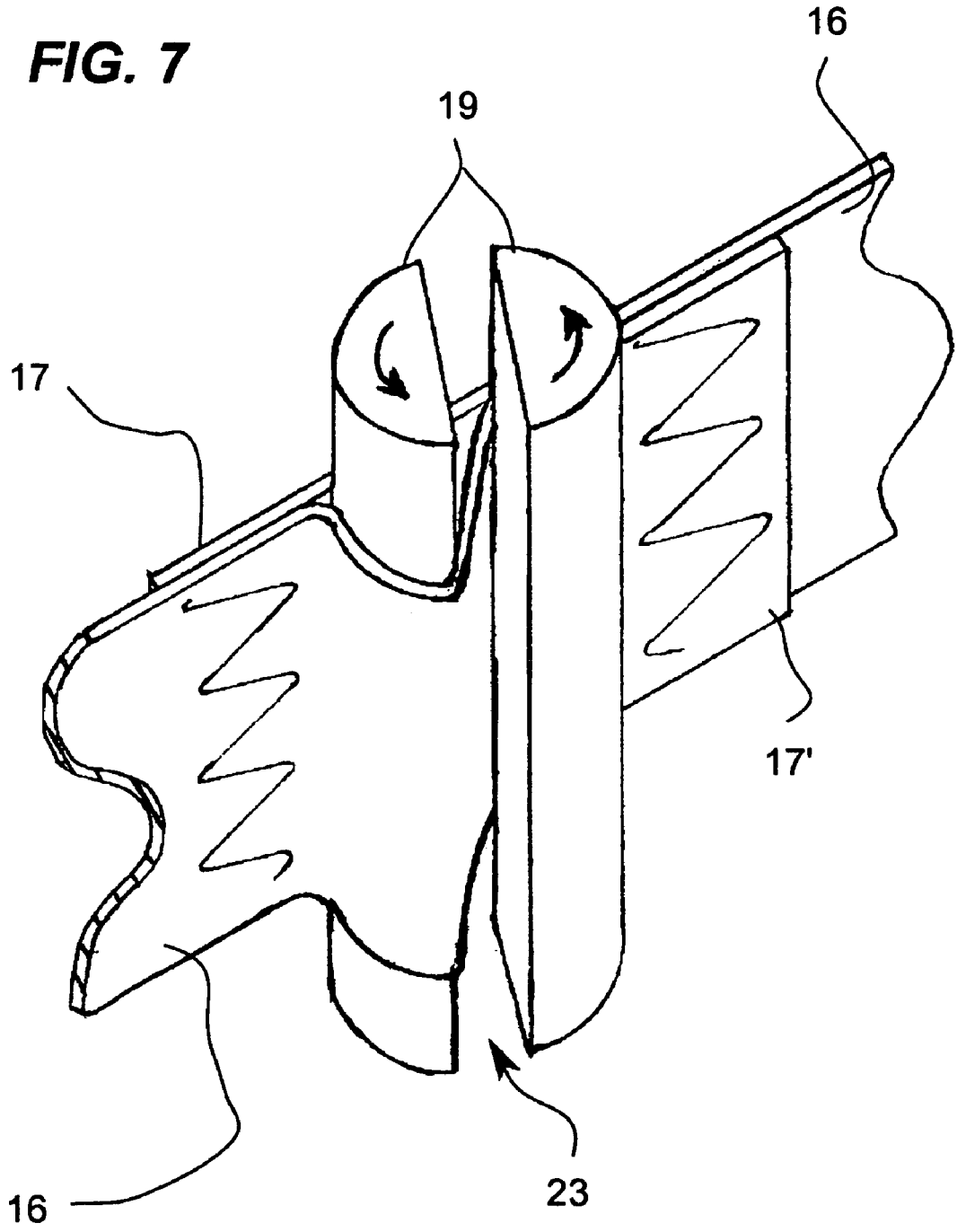

FIG. 7 Perspective view of the reel with strap ends.

DETAILED DESCRIPTION OF THE PREFERRED EMBODIMENT

A compressing device for bottle (10) has a first plate (12) on one side of a bottle (14) and a second plate known as the tightening means plate (12') since it has a tightening means fixedly attached to it. The tightening means plate (12') being opposite the first plate (12) on the other side of the bottle (14) is. A strap (16), attached to the tightening means (18), allows for the two plates (12, 12') to be tightened against the bottle (14). The strap (16) is fixedly attached to the first plate (12) opposite the tightening means plate (12') so as to bring both plates (12, 12') toward each other in a parallel fashion as will be explained in more detail later.

In order to minimize damage to the bottle (14) when tightening it, the plates (12, 12') have a convex shape (20) on their upper part, and a concave shape (22) on their lower part. Moreover, beveled edges (13, 15) on both the convex and concave shapes (20, 22) are so beveled so as to reduce potential creasing of the bottle (14).

The beveled edge (15) at the base of plates (12, 12') maintains strength integrity in the bottle (14) even when fully compressed and preserves the shape of the bottle's (14) base (33) so that it does not lose its stability even if a stand (30) is not present. The sides of the plates (12, 12') are rounded off where the strap (16) passes so as not to put undue wear on the strap (16). In order to reduce the width of the plates (12, 12') vertical sides (11) are also beveled to prevent edges of the bottle (14) from folding onto themselves once compressed.

When installing the compressing device (10) on a new bottle (14), in order to facilitate proper alignment and adjustment of the height of the plates (12, 12'), a ring (28) holds an adjustable handle side strap (25) so named because it is on the side where a handle (27) and to differentiate it from an adjustable strap (26) on the opposite side of the bottle (14). Both straps (25, 26) are adjustable lengthwise so as to be adaptable to various bottle (14) sizes and perform the same duty, which is to hold the plates (12, 12'). The adjustable straps (25 and 26) can be made adjustable by way of hook and pile means. When first installing the compressing device for bottle (10) over a bottle (14), the ring (28) allows both straps (25, 26) to be adjusted so that the plates (12, 12') are substantially at the same height along the bottle (14) and then, the tightening means (18) is tightened to maintain the necessary tension as the bottle (14) is progressively emptied over time.

An optional stand (30) is attached to tightening means plate (12'). The stand (30) can be fixedly attached to tightening means plate (12') or it can be releasably attached, in which case the compressing device (10) is more versatile. Because attachment means, whether fixed or releasable for the stand (30) of this configuration would be obvious, no further details will be given. It should be understood that whether the stand (30) is removable or fixed falls within the scope of this single invention. The stand (30) has a pair of feet (31), preferably but not necessarily of a triangular configuration for increased structural strength, set at a distance allowing for the bottle's (14) base (33) to fit in between the feet (31) and help in centring the bottle (14) in relation with the plates (12, 12'). The triangular shape of the feet (31) favors the curvature typically found on the base (33) of bottles (14).

Legs (29), which are part of the stand (30), form an acute angle with the feet (31), which gives better balance to the compressing device for bottle (10) and helps in supporting the bottle should deformation of the bottle's (14) base (33) occur once it is fully compressed. When using the stand (30), tightening means plate (12') is held by the stand (30) and the handle strap (25), which is held by the ring (28), is sufficient to hold the first plate (12) so that adjustable strap (26) is not necessary and can be removed completely at the discretion of the user. Because of the presence of the stand (30), it is preferable that the bottle (14) be lowered into the compressing device (10), in which case, having the adjustable strap (26) out of the way would be practical.

In order for the compressing device for bottle (10) to be operative, the stand (30) is not compulsory as the bottle (14) even when compressed can still hold up. The removal of the stand (30) can be practical when space is limited.

A handle (27) fixedly attached to first plate (12) is used for pouring, general handling of the compressing device for bottle (10), and the removal of the plates (12, 12') for replacing the bottle (14).

The tightening means comes in the guise of a ratchet device which has at it's core a reel (19). Such ratchet device is known in the art except for an important difference in configuration which has the two ends (17, 17') of the strap (16) attached together on each side of the reel (19) in such a way that one end (17) of the strap (16) passes around the reel (19) and the other end (17') passes through the slit (23) made into the reel (19). In this manner, by actuating the tightening means (18) both ends (17, 17') are simultaneously wound around the reel (19) and since the strap (16) is fixedly attached to first plate (12), both plates (12, 12') move closer together in a parallel fashion. A guide (21), part of the tightening means (18), guides the strap (16). Usually, such ratcheting means known in the art only have one end engaging the reel (19) and therefore cannot produce the result described herein.

In order to use the compressing device for bottle (10), allows air is allowed to escape either by removing or at least loosening the bottle cap (32) and squeezes the bottle (14) with the compressing device (10) until the content reaches the top of the bottle (14). The cap (32) can then be tightly screwed back on to block air ingress or egress.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A compressing device for bottle comprising:

a strap fixedly attached on a first plate and a tightening means fixedly attached on a tightening means plate opposite said first plate;

said tightening means being a ratchet device comprising a reel;

said strap having two ends and said two ends being attached together on each side of said reel in such a way that one end of said strap passes through a slit made into said reel and said other end passing around said reel so as to bring both said plates toward each other in a parallel fashion;

said plates having a convex shape on an upper part of said plates, and a concave shape on a lower part of said plates;

said convex and concave shapes having beveled edges to provide a controlled compression to maintain strength integrity in said bottle by reducing compression on a base of said bottle.

2. A compressing device for bottle as in claim 1 wherein:

a ring to hold an adjustable handle side strap linking said ring to said first plate.

3. A compressing device for bottle as in claim 1 wherein:

a ring to hold an adjustable strap linking said ring to said tightening means plate.

4. A compressing device for bottle as in claim 1 wherein:

adjustable handle side strap and adjustable strap both being linked to ring and both being adjustable lengthwise so as to be adaptable to various bottle sizes.

5. A compressing device for bottle as in claim 1 wherein:

handle fixedly attached on said first plate.

6. A compressing device for bottle as in claim 1 wherein:

said first plate and said tightening means plate having vertical sides beveled to prevent edges of said bottle from folding onto themselves once compressed.

7. A compressing device for bottle as in claim 1 wherein:
a stand attached to said tightening means plate;
said stand having a pair of feet, set at a distance allowing for the base of the bottle to fit therein.

8. A compressing device for bottle as in claim 7 wherein:
legs, which are part of said stand forming an acute angle with said feet.

9. A compressing device for bottle as in claim 7 wherein:
said feet being of a triangular configuration for centring said base.

10. A compressing device for bottle as in claim 1 wherein:
a guide extending from said tightening means to guide said strap.

11. A compressing device for bottle as in claim 4 wherein:
said straps being adjustable by way of hook and pile means.

12. A compressing device for bottle as in claim 4 wherein:
said adjustable strap and said adjustable handle side strap being attached to said ring;
said adjustable strap and said adjustable handle side strap being adjustable lengthwise so as to align both said first plate and said tightening means plate.

13. A compressing device for bottle comprising:
a strap fixedly attached on a first plate and a tightening means fixedly attached on a tightening means plate opposite said first plate;
said tightening means being a ratchet device comprising a reel;
said strap having two ends and said two ends being attached together on each side of said reel in such a way that one end of said strap passes through a slit made into said reel and said other end passing around said reel so as to bring both said plates toward each other in a parallel fashion;
said plates having a convex shape on an upper part of said plates, and a concave shape on a lower part of said plates;
said convex and concave shapes having beveled edges to provide a controlled compression to maintain strength integrity in said bottle by reducing compression on a base of said bottle;
ring to hold an adjustable handle side strap linking said ring to said first plate;
ring to hold an adjustable strap linking said ring to said tightening means plate;
said adjustable handle side strap and said adjustable strap both being linked to said ring and both being adjustable lengthwise so as to be adaptable to various bottle sizes;
a stand attached to said tightening means plate;
said stand having a pair of feet, set at a distance allowing for the base of the bottle to fit therein.

14. A compressing device for bottle as in claim 13 wherein: said tightening means plate being supported by said stand and said adjustable handle side strap being adjusted lengthwise so as to align said first plate with said tightening means plate.

15. A compressing device for bottle as in claim 1 having the following method of use:
allowing air to escape from said bottle and squeezing said bottle between said first plate and said tightening means plate until the content reaches the top of said bottle, and then blocking air ingress or egress.

* * * * *